US008037662B1

(12) United States Patent
Roose

(10) Patent No.: US 8,037,662 B1
(45) Date of Patent: Oct. 18, 2011

(54) METHOD FOR SHOCK-ABSORBING PACKAGING

(76) Inventor: Lars D. Roose, Albuquerque, NM (US)

( * ) Notice: Subject to any disclaimer, the term of this patent is extended or adjusted under 35 U.S.C. 154(b) by 0 days.

(21) Appl. No.: 12/330,082

(22) Filed: Dec. 8, 2008

Related U.S. Application Data

(63) Continuation of application No. 11/135,751, filed on May 23, 2005, now Pat. No. 7,516,597.

(60) Provisional application No. 60/573,261, filed on May 21, 2004.

(51) Int. Cl.
*B65B 11/58* (2006.01)
*B65B 61/22* (2006.01)

(52) U.S. Cl. ..... 53/449; 53/139.5

(58) Field of Classification Search ..... 53/139.5, 53/139.6, 139.7, 449; 206/583, 591
See application file for complete search history.

(56) References Cited

U.S. PATENT DOCUMENTS

| | | | | |
|---|---|---|---|---|
| 1,842,034 | A | | 1/1932 | Lewis |
| 2,335,779 | A | | 11/1943 | Mazzei |
| 2,527,541 | A | | 10/1950 | Gibbs |
| 2,615,707 | A | | 10/1952 | Rowe et al. |
| 2,653,709 | A | | 9/1953 | Cunningham et al. |
| 2,688,059 | A | | 8/1954 | Holzinger et al. |
| 2,696,322 | A | | 12/1954 | Densen |
| 2,779,464 | A | * | 1/1957 | Cairnes et al. ..... 206/583 |
| 2,919,046 | A | | 12/1959 | Parsons |
| 2,932,546 | A | | 4/1960 | Marggraf et al. |
| 2,965,275 | A | * | 12/1960 | Langford ..... 206/583 |
| 2,965,371 | A | | 12/1960 | Gulardo |
| 2,977,043 | A | | 3/1961 | Scheldorf |
| 3,109,639 | A | * | 11/1963 | Nicolaisen ..... 206/591 |
| 3,129,836 | A | | 4/1964 | Frevel |
| 3,635,332 | A | * | 1/1972 | Ross ..... 206/591 |
| 3,735,952 | A | | 5/1973 | Platus et al. |
| 3,752,301 | A | * | 8/1973 | Bluemel ..... 206/583 |
| 3,752,384 | A | * | 8/1973 | Siburn ..... 206/591 |
| 4,013,170 | A | | 3/1977 | Hutterer |
| 4,117,933 | A | * | 10/1978 | Lachance ..... 206/583 |
| 4,574,955 | A | | 3/1986 | Camossi |
| 5,285,902 | A | | 2/1994 | Tabuenca Garcia |
| 5,538,155 | A | | 7/1996 | Hoekstra |
| 5,573,119 | A | * | 11/1996 | Luray ..... 206/583 |
| 5,655,662 | A | | 8/1997 | Garcia |
| 5,823,348 | A | | 10/1998 | Phillips et al. |

* cited by examiner

*Primary Examiner* — Christopher Harmon
(74) *Attorney, Agent, or Firm* — Justin R. Jackson; Peacock Myers, P.C.

(57) ABSTRACT

Method for providing shock absorbing packaging wherein fragile, dangerous, or otherwise valuable cargo can be shipped through normal or abnormal shipping routes while absorbing acceleration and deceleration shock forces which would otherwise damage such cargo.

18 Claims, 17 Drawing Sheets

METHOD FOR SHOCK-ABSORBING PACKAGING

CROSS-REFERENCE TO RELATED APPLICATIONS

This application is a continuation application of U.S. patent application Ser. No. 11/135,751, entitled "METHOD AND APPARATUS FOR SHOCK-ABSORBING PACKAGING", to Lars D. Roose, filed on May 23, 2005, now issued as U.S. Pat. No. 7,516,597, which claims priority to and the benefit of the filing of U.S. Provisional Patent Application Ser. No. 60/573,261, entitled "Webbed Suspension Packaging", filed on May 21, 2004, and the specification and claims (if any) thereof are incorporated herein by reference.

BACKGROUND OF THE INVENTION

1. Field of the Invention (Technical Field)

The present invention relates to a method and apparatus for reducing shock to objects during shipping or transport. More particularly, the present invention relates to a method and apparatus wherein objects to be shipped are placed within a first container which is suspended within a larger second container through the use of elastic members. Desirable results can be obtained with the present invention when members are used which support inner box within outer box through the use of repulsive forces, which push opposing sides of an inner box away from opposing sides of an outer box or through the use of attractive forces, which pull opposing sides of an inner box to opposing sides of an outer box.

Costly fragile or volatile and dangerous hazardous objects which are trucked, shipped, or mailed over distances are often subject to rough handling which may include dropping, kicking, tossing, general mishandling by persons, or numerous other abuses. These incidents typically occur when the objects are no longer under the control of the person who packaged them.

2. Description of Related Art

The history of shock absorption is well known, especially with anyone who has driven an automobile, where shock absorbers, or "shocks", provide the passengers with a smoother ride while the car is moving.

Various methods and apparatuses for protecting delicate, valuable, and breakable objects are generally known. These are typically referred to as packaging materials. These packaging materials often take the form of bubble-wrap, foam peanuts, blocks, and/or foam padding. Typically, for example, an extremely fragile item which is desired to be shipped to a remote location will be "double-boxed". This means the object itself is padded and snugly packaged inside an inner box. The inner box is then in turn wrapped snugly with additional packing material, and thereafter stuffed into a larger outer box. With double-boxing, although the fragile objects themselves will be well protected from intentional or unintentional abuses (as if the outer box becomes crunched etc.), the object may still be vulnerable to damage due to shock forces which are experienced by the package. In other words, if the package is dropped during transit, the object's internal structure may be damaged through the sudden deceleration which is well known and understood as a shock force. If the particular object needing packaging protection is an antique vacuum tube (as was the exact case which inspired the present invention), which has an internal structure within an outer glass envelope containing the vacuum. This internal structure can actually break the outer glass envelope of the vacuum tube, from the inside. This is due to the sudden shock force which is generated when the package is dropped. Damage to the vacuum tube can occur even if the inner structure of the vacuum tube does not damage the glass envelope itself. The shock force and/or vibration therefrom can be enough to displace or de-position any related structure, so that the original operating characteristics of the vacuum tube are greatly changed. As a further example, a light-bulb can be irreparably damaged by a shock force, its filament can detach or break when the package is dropped.

In another example, a rare and invaluable Chinese vase can suffer damage produced by shock force when the package is dropped. The instantaneous deceleration-induced shock felt by the actual vase in spite of having the best package padding, could still be sufficient to cause the vase to break. Even if the vase does not break, a hairline-crack can be formed. This would still be devastating to the owner of the vase. Even if a hairline-crack is not observed, the impact may weaken the vase by an imperceptible amount which would contribute to its long term accelerated degradation.

It should also be noted that the U.S. Postal Service does not insure any package for shock-induced damages.

Since conventional packaging materials and methods often fail to prevent damage to shipped objects which result from a shock force, there is thus a present need for a method and apparatus which greatly reduces the likelihood of damage occurring to shipped objects which results from a shock force.

BRIEF SUMMARY OF THE INVENTION

The present invention relates to a method for packaging an item for shipping having the steps of disposing the item within an inner box, disposing the inner box at least partially within an outer box, and connecting the inner box with the outer box at a plurality of points with at least one elastic member. One or more hooks can also be provided, and the hooks can have a recess disposed therein for receiving a pin. At least one of the hooks can have a sheet fixedly secured to it, and the sheet can optionally be angled. Further, the sheet can be adhesively connected to one of the boxes. A dampening pad can be disposed over at least one of the elastic members. The elastic members themselves can comprise a rubber band and/or a bungee.

The present invention also relates to a packaging apparatus that has an inner box and an outer box. The inner box is disposed at least partially within the outer box and the inner box is physically connected to the outer box with at least one elastic member. At least one of the elastic members can comprise a rubber band, a bungee, and/or a spring. The packaging apparatus can also have one or more hooks which themselves connect to one of the boxes and to an elastic member. At least one dampening pad can also be added to the packaging apparatus of the present invention. The pad can be spirally-wound and/or the pad can have a substantially cylindrical shape with an opening traversing through it in a substantially axial fashion.

The present invention also relates to a method for shipping an item having the steps of disposing the item in an inner box, disposing the inner box at least partially within an outer box, and separating the inner box from the outer box on at least one side with at least one spring. The inner box can be separated from the outer box on a plurality of sides by disposing at least one spring between each of the plurality of sides. The springs can be selected such that they are partially compressed when residing in their at-rest state as installed between the boxes.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
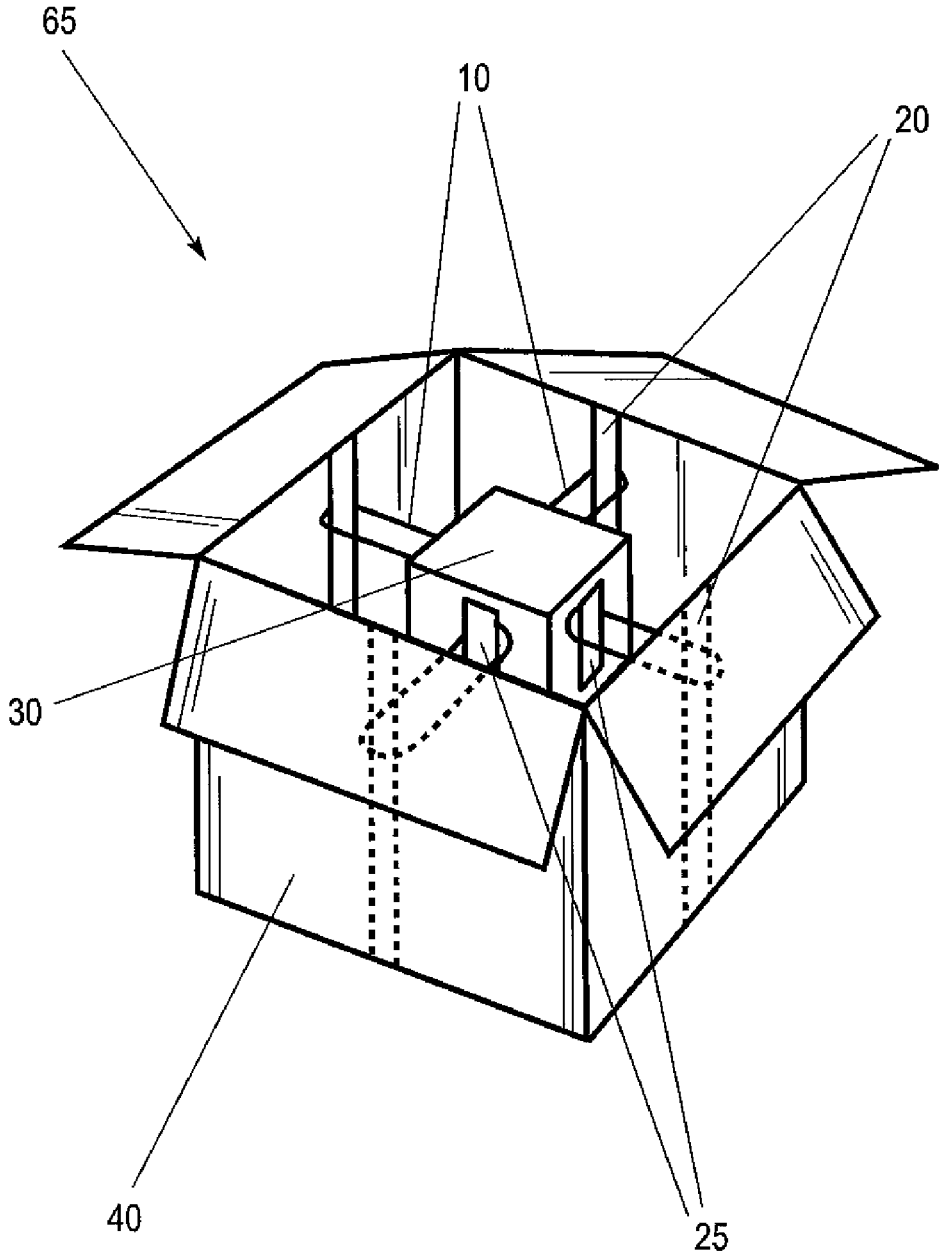
FIG. 1 is drawing showing an embodiment of the present invention wherein tape is used to secure elastic members to surfaces of the boxes.

The present invention is directed toward an inexpensive and greatly improved way of providing shock absorbing properties to packaging materials. This is particularly true for the shipment of delicate, fragile, and valuable objects such that a smoother ride is provided to the objects. An objective of the present invention is to provide elastic or equivalent shock absorbing properties between inner and outer boxes. The present invention can use common rubber bands for the elastic shock-absorbing members. The elastic members expand longitudinally under tension between the outer confines of the inner box and the inner confines of the outer box. A protecting elastic suspension web is thus provided which can consist of individually installed single elastic members which are attached between boxes.

Some of the benefits provided by the present invention include: better safety provided to fragile valuable or volatile objects during shipping; less space required for shipping and/or storage thereof than conventional padding such as bubble-wrap or styro-peanuts; less time and effort is required to implement the present invention than that typically required for the tedious wrapping, taping, and packing typically employed; and the present invention provides a less expensive way to ship items due to the reduced volume and weight saved from conventional packaging materials.

Standardized parts and procedures can be employed by companies who specialize in packaging and shipping items for others, such as "mail boxes etc.". There can be made a standard chart/table with sizes and weights of objects, or simply the size and weight of an "inner box", and the chart can be used to determine which dimensions the outer box should have, as well as which hook/fasteners, and associated springs/elastic members should be used, thus resulting in a standard which will aid individuals in purchasing appropriate materials.

The term "box" as used throughout the specification and claims of this application is used for the sake of simplicity and is intended to include any shipping structure or container. Such structures or containers may include, but are not limited to: boxes of any shape, buckets, barrels, cargo containers, bottles, jars, tubs, etc. Such boxes can be constructed from an almost infinite number of materials and or combinations thereof and this disclosure is intended to encompass all of them.

The term "elastic member" as used throughout the specification and claims of this application is also used for the sake of simplicity in an effort to maintain consistency and is intended to include any material or device which is capable of absorbing shock. Such materials and devices can include, but are not limited to: rubber bands or rubber strands of any number, type, shape, or size, any bungee device or material, any elastic device or material, any spring or assembly thereof, as well as any shock absorbing device or devices.

The term "hook" as used throughout the specification and claims of this application is also used for the sake of simplicity and is intended to include any material or device which is capable of receiving, securing, affixing to, or holding an elastic member as defined herein.

Referring now to FIG. 1, in a first embodiment, inner box 30 has a first length of tape 25 threaded through a loop of elastic member 10, and taped to an outer flat surface of inner box 30. A second length of tape 20 is threaded through elastic member 10 and affixed to the opposing inside flat wall of outer box 40. While virtually any type of tape can be used having sufficient adhesive properties such that the tape remains affixed to the surface of the box, it is preferred that the tape used be a packaging tape. In one embodiment, each of the flat outside surfaces of inner box 30 have attached thereto a first portion of elastic member 10. A second portion of each elastic member 10 is attached to the inside flat surfaces of outer box 40. Thus, when complete package 65 is dropped to the floor, inside box 30 will swing up and down, side-to-side, or a combination of vertical and horizontal swinging-motion components, thus lengthening the time of deceleration or acceleration of the inner box and thereby reducing the shock that would otherwise be experienced by the contents of inner box 30. Of course, other materials such as staples, which are capable of securing elastic member 10 to a portion of box 30 or 40, can be used in place of tape and will produce desirable results.

Figure 2:
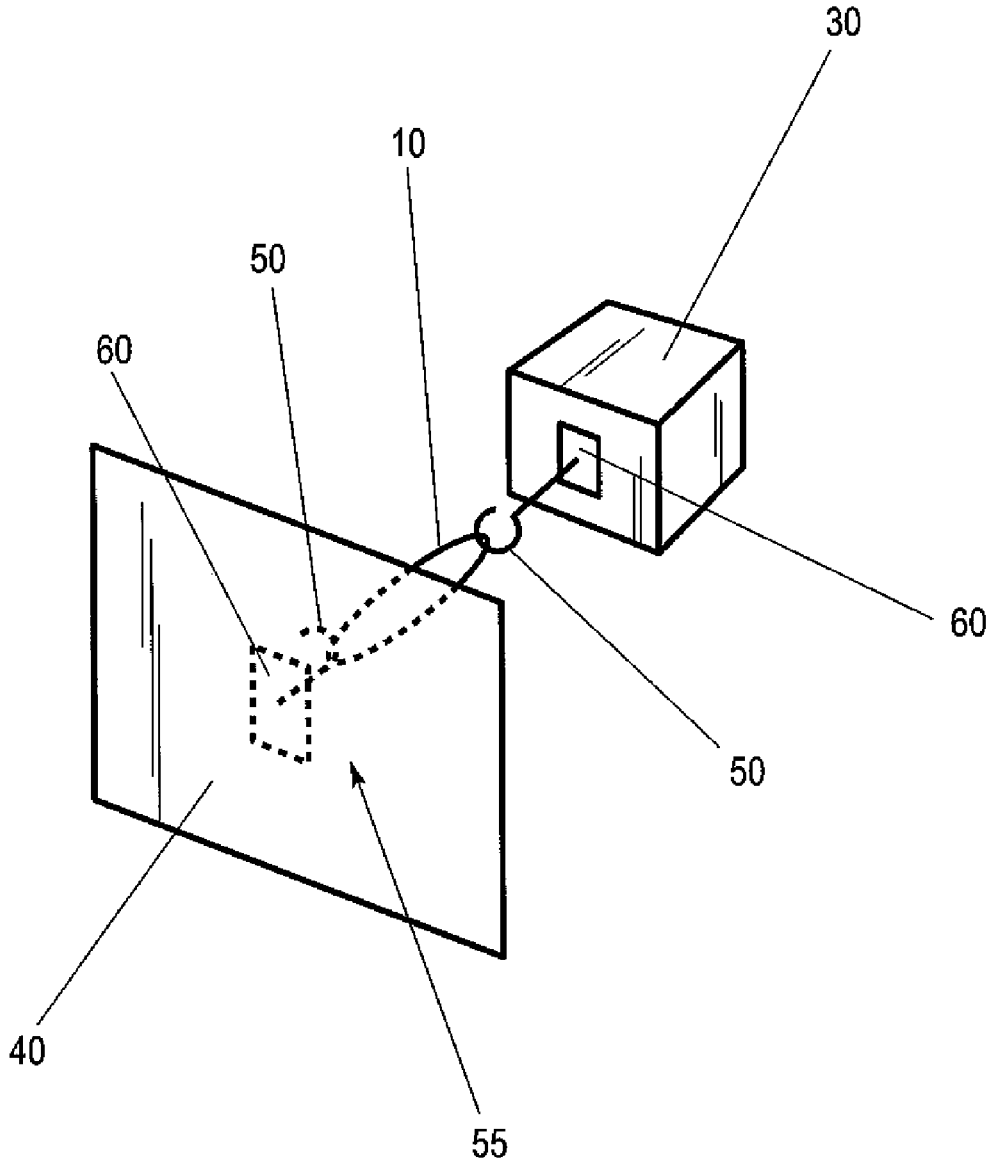
FIG. 2 is drawing showing an embodiment of the present invention wherein adhesive backed hook members are used to attach elastic members between opposing wall surfaces of the boxes.

In another embodiment, as depicted in FIG. 2, member 55 is used in place of tape 20. Member 55 preferably comprises sheet 60 of approximately 1 or 2 square inches. While those skilled in the art will readily recognize that a tremendous number of materials can be used to create sheet 60, sheet 60 preferably comprises a plastic material. Adhesive is preferably provided on one side of the sheet 60. Hook 50 is preferably fixedly attached to and protrudes from a central portion of sheet 60 on a side opposing that which contains the adhesive. A first set of these members is positioned on outer surfaces of inner box 30. A second set of members 55 is preferably disposed on inner surfaces of outer box 40 such that hooks 50 of the first set substantially face hooks 50 of the second set. Elastic members 10 are then disposed between each of the facing hooks. Simply hooking elastic members 10 with hooks 50 properly disposes elastic members 10. This results in inner box 30 being suspended within a web of elastic members 10 within outer box 40. Just as with the first embodiment, when complete package 65 is dropped to the floor, elastic members 10 absorb the shock, so that the contents in inner box 30 is not nearly as susceptible to damage as without the elastic members web of the present invention. In this embodiment, if pointed hooks are used, the adhesive need not be applied to sheet 60. Rather, the point of the hook can simply be "punched" through the box such that the tension provided by elastic members 10 is used to hold sheet 60 in place against a surface of the box opposite that on which hook 50 protrudes therefrom.

The sides of cardboard boxes are much more vulnerable during transit in any shipping process than the corners are. For example, the flat panels, (top, bottom, and sides), are much easier to crush or dent inward than the corners of the box are. If these panels are caved in, due to rough handling, then elastic member(s) 10, which are disposed therebetween, can exhibit slack and thus no longer absorb shock to as great of an extent. A third embodiment is therefore provided which is directed toward suspending inner box 30 from the inside corners of outer box 40. The corners to which this third embodiment is primarily directed are those linear portions wherein two flat panels meet. While adhesive may be used to further secure the members in this embodiment, adhesive is not required to be used.

Figure 3A:
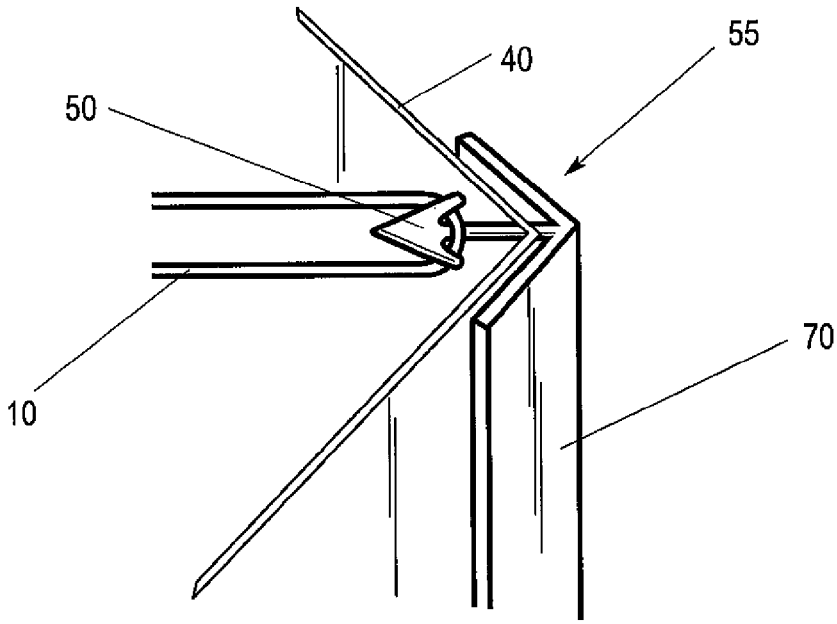
FIG. 3A is drawing showing an embodiment of the present invention wherein hooks are provided which project from an inner angle of a corner support.
Figure 4:
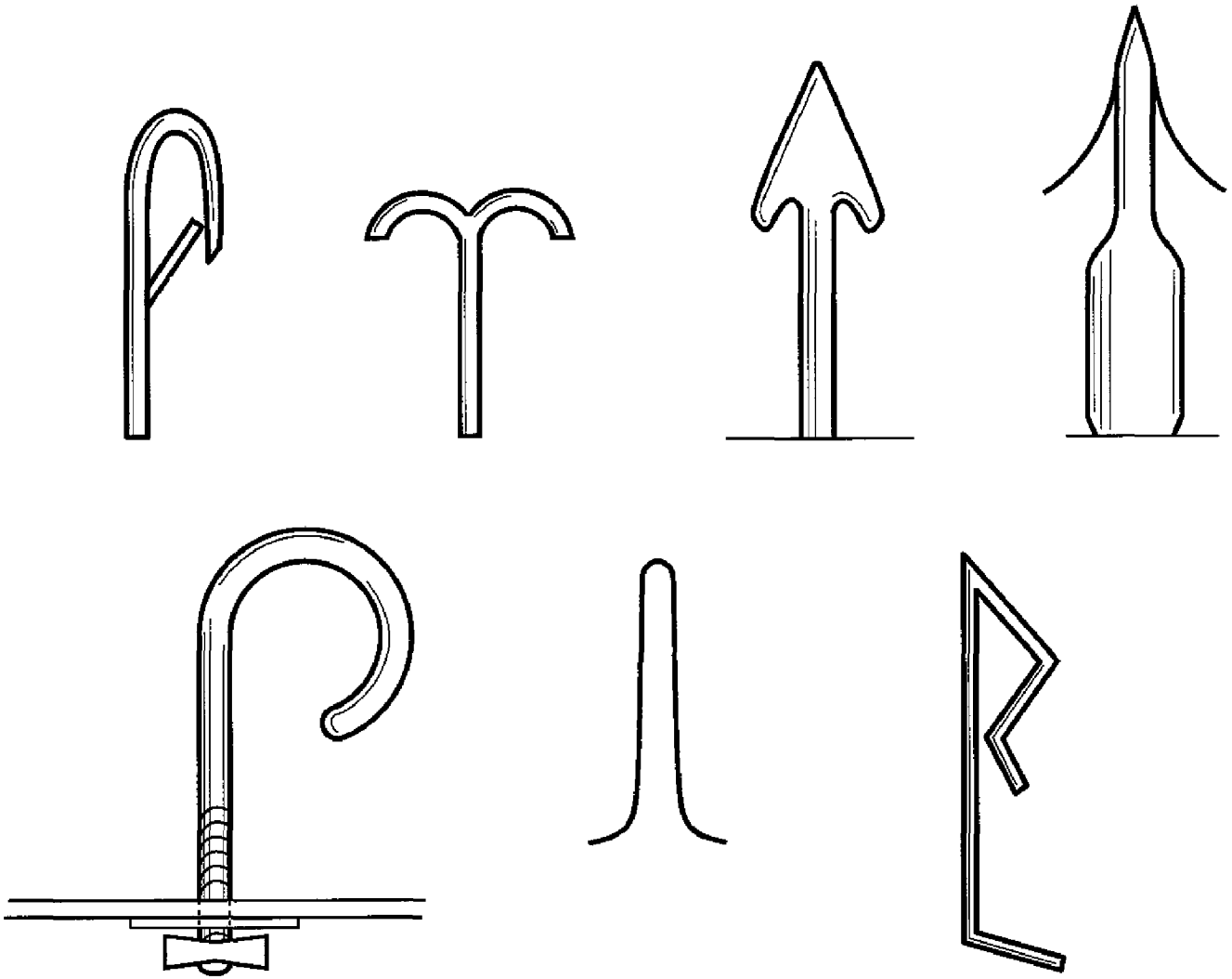
FIG. 4 is a drawing depicting a few of the numerous shapes of hooks which can be used in accordance with the present invention.

In this third embodiment (see FIG. 3A), instead of sheet 60 comprising a flat sheet, with a sticky surface and an opposing hooked surface as provided in the second embodiment, member 55 preferably has angled sheet 70 in place thereof. While an almost unlimited number of materials or combinations of materials can be used and will produce desirable results, it is preferred that member 55 be constructed as a one-piece molded plastic member. The angle of angled sheet 70 is preferably substantially the same as the angle of the corner of the box. For example, if inner and outer boxes are square, it is preferred that angled sheet 70 comprise an angle of about 90-degrees. In this embodiment, member 55, which is provided on outer box 40, preferably comprises hook 50 which is disposed on and protrudes from an inner corner of angled sheet 70. For those members which are provided in inner box 30, member 55 preferably comprises hook 50 which is disposed on and protrudes from an outer corner of angled sheet 70. The method of employment and assembly for this embodiment preferably includes the additional steps of providing hooks 50 which are pointed and then shoving pointed hooks 50 through corners of boxes 30 and 40 by applying pressure to angled sheet 70. Of course, numerous designs of hook 50 can be imagined, a few of which are shown in FIG. 4. Hook 50, for example can be a relatively straight pointed shaft having flexibly resilient barbs which expand in a fashion similar to the wings on toggle bolts when the shaft has pierced the box surface. After a user disposes members 55 about outer box 40, the user then provides opposing members 55 to inside box 30. Instead of glue, it is preferred that the tension from elastic member 10 holds angled sheets 70 in place. As with previous embodiments, after a plurality of elastic members 10 have been disposed on hooks 70, inner box 30 becomes elastically suspended at equal distances with equal elastic suspension forces within outer box 40. Since the outer surface of angled sheets are exposed and may become snagged, or caught on another object or package during shipping, it is preferred that a piece of standard packaging tape is stuck over angled sheets 70 and adhered to outer box 40.

Figure 5:
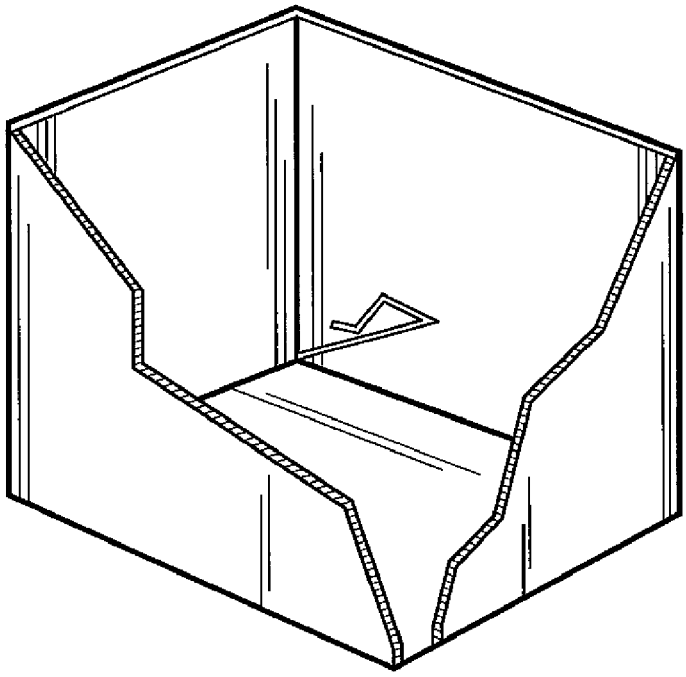
FIG. 5 is a drawing of a 3-sided inside hook piece which can be used to secure a hook to a corner of a box.
Figure 6:
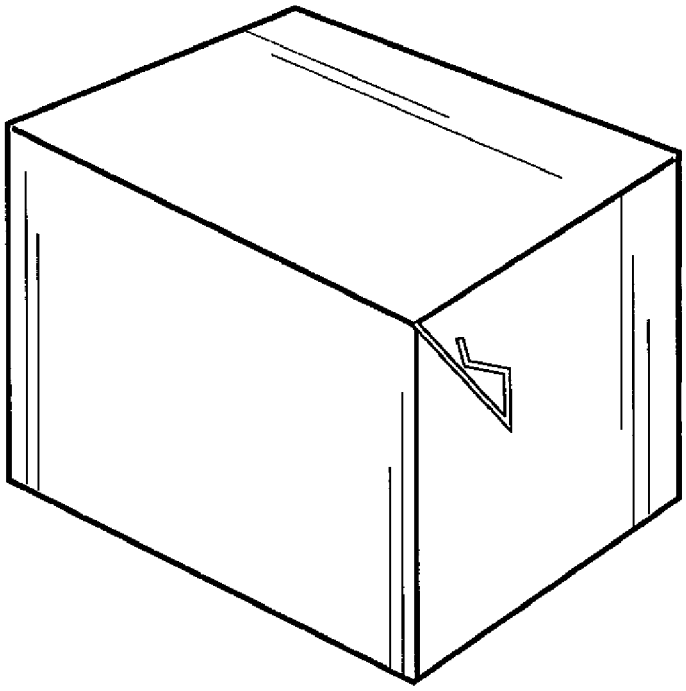
FIG. 6 is a drawing of a 3-sided outside hook piece which can be affixed to an outside corner of an inner box such that a hook is provided at a corner of the box.

In yet another embodiment, the previous (third) embodiment is adapted to be used in the corners of the corners (i.e. those places where three or more flat surfaces meet). In this embodiment, shown in FIGS. 5 and 6, the same principals as used in the third embodiment apply.

Figure 3B:
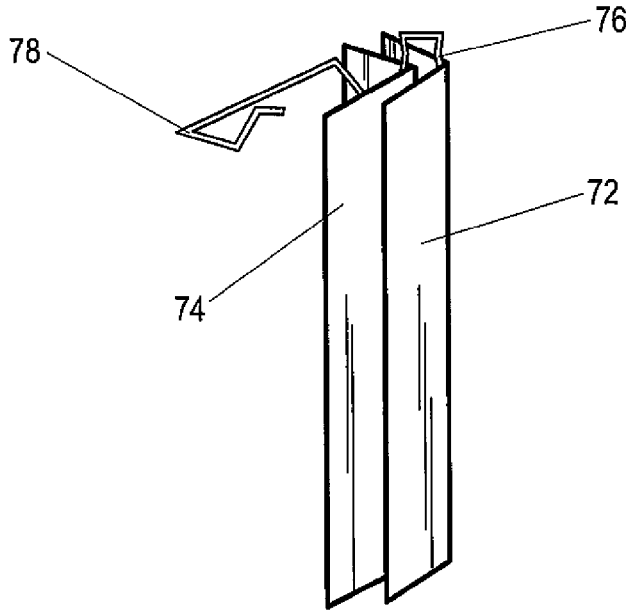
FIGS. 3B and 3C are drawings showing isometric and top views respectively of an embodiment of a hook which is shaped to be slid into a corner of a box in accordance with the present invention.
Figure 3C:
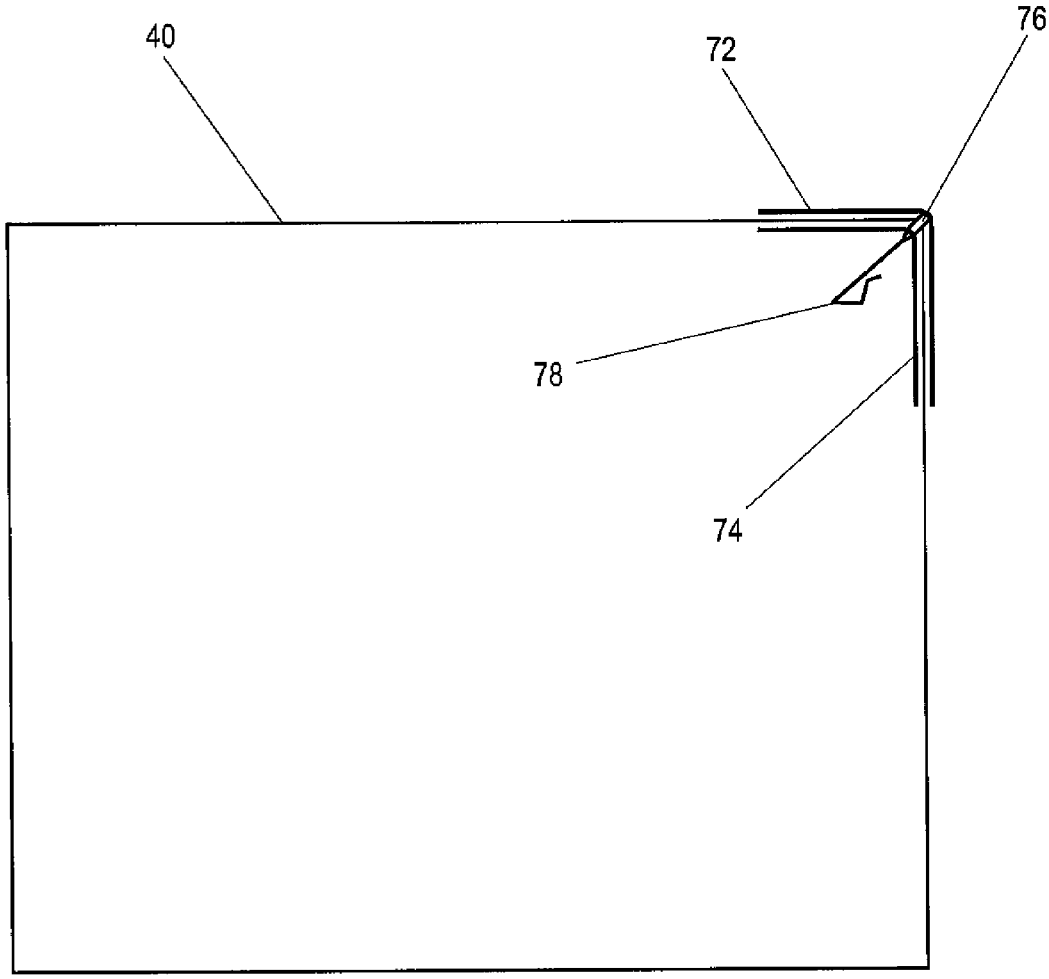

As depicted in FIGS. 3B and 3C, a corner hook can be fabricated which can simply be slid onto a corner of a box. In this embodiment, outer angled sheet 72 is preferably affixed in a substantially parallel fashion with inner angled sheet 74 by flat top piece 76. Hook 78 preferably protrudes from a corner of angled plates 72 or 74, depending on whether it is preferable that hook 78 protrudes from, or extends into a box. FIG. 3*c* shows an embodiment wherein hook 78 extends into outer box 40. As such, hook 78 extends from a corner of inner angled sheet 74. In this embodiment, outer angled sheet 72 and inner angled sheet 74 sandwich a corner of a box therebetween. Although this embodiment is depicted as having an inner and an outer angled plate, desirable results could also be achieved with alternative shapes (i.e. inner angled sheet 74 could be replaced by a rod shaped member which extends down an inside corner of a box, and which rod-shaped member can have a hook affixed thereto). As such, this embodiment is not limited only to the particular structures depicted in the drawings, but rather any type of hook holding member which can be slid over a corner of a box.

Upon reading this application, those skilled in the art will readily recognize numerous types and styles of members 55 which may be used and will provide desirable results. Some members, which could easily be used in place of or in conjunction with the preceding embodiments includes members having a hook on a proximate end and threads on a terminal end. The member could thus easily be screwed into or bolted onto the inner or outer box, rather than by gluing it thereto (see FIG. 4).

Of course, desirable results can be obtained by using any combination of the above-described embodiments. Also, additional "layers" of boxes can be used and will also provide desirable results. For example a first inner box can be disposed within the web-like structure of the present invention within a second inner box which itself could be disposed within the web-like structure of the present invention within an outer box.

When shock absorbers are used in place of elastic members in the present invention, it is preferable that such shock absorbers be secured to the inside of outer box 40 and the outside of inner box 30 with the aid of one or more ball joints or other swiveling devices. This is especially true for large cargo transport containers, particularly where hazardous, dangerous and/or volatile payloads are of interest. The use of such shock absorbers is particularly useful in large-scale hazardous waste-loads where public safety and ecological integrity are at risk during their shipping.

Figure 7:
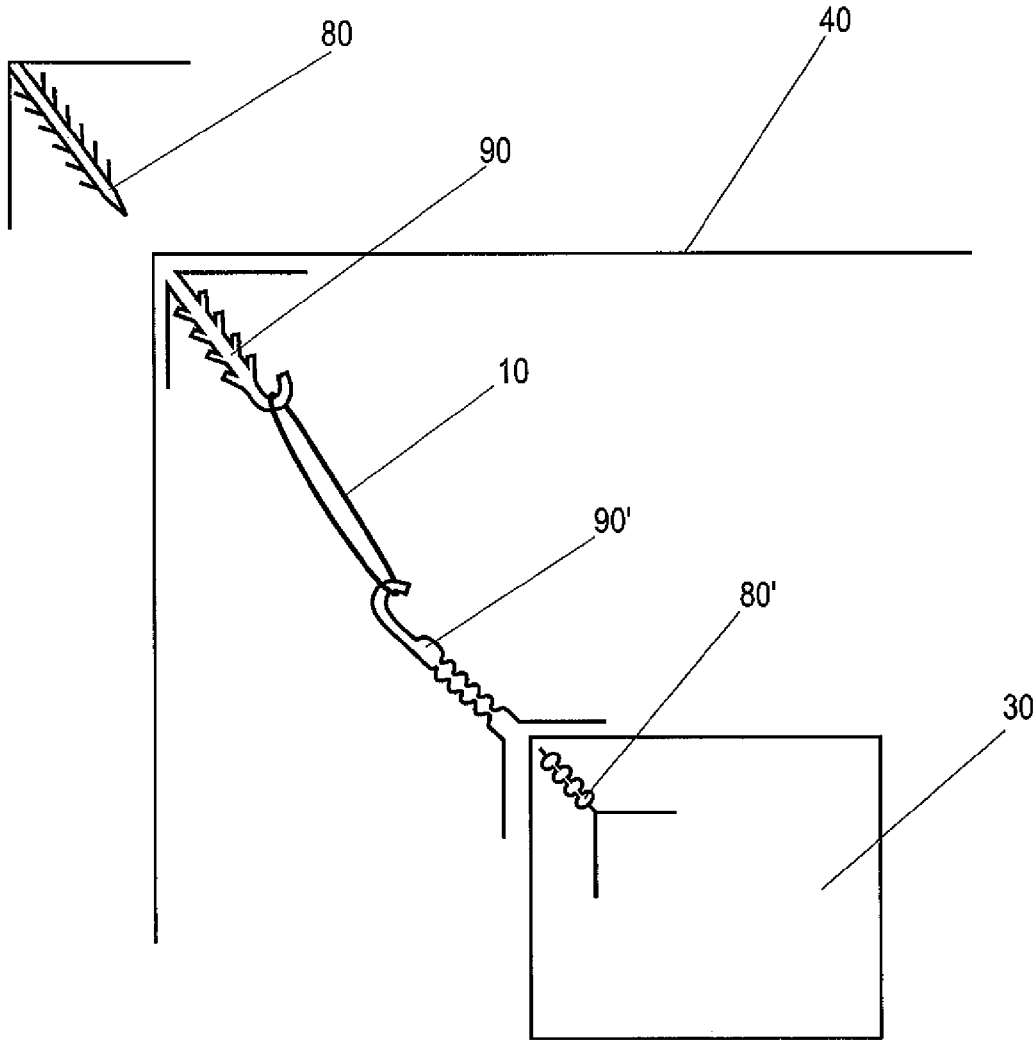
FIG. 7 is a drawing showing a preferred shape of the components of the hooked-shaped elastic member retaining device of the present invention.

Referring now to FIG. 7, an embodiment of the present invention is depicted wherein inner box 30 is preferably suspended within outer box 40 by elastic member 10. Although this drawing shows only one corner being suspended, the present invention provides desirable results when multiple corners are suspended, and the teachings for suspending a single corner are equally applicable to other corners. As shown therein, ribbed corner pin members 80 and 80' are preferably penetrate outer and inner boxes 40 and 30 respectively. Pin members 80 and 80' are then preferably inserted into hook members 90 and 90'. Pin members 80 and 80' are depicted as having protrusions or an otherwise ribbed surface. These surfaces preferably fit within and otherwise mate with inner surfaces of hook members 90 and 90', thereby enabling pins 80 and 80' to be secured and held by hooks 90 and 90'. Although only two possible shapes of pins and hooks are depicted, pins having various protrusions or other outer surface shapes can be used and will produce desirable results, particularly if their respective hooks have internal recesses which substantially match the outer protrusions of the pins when fully inserted therein.

Figure 8:
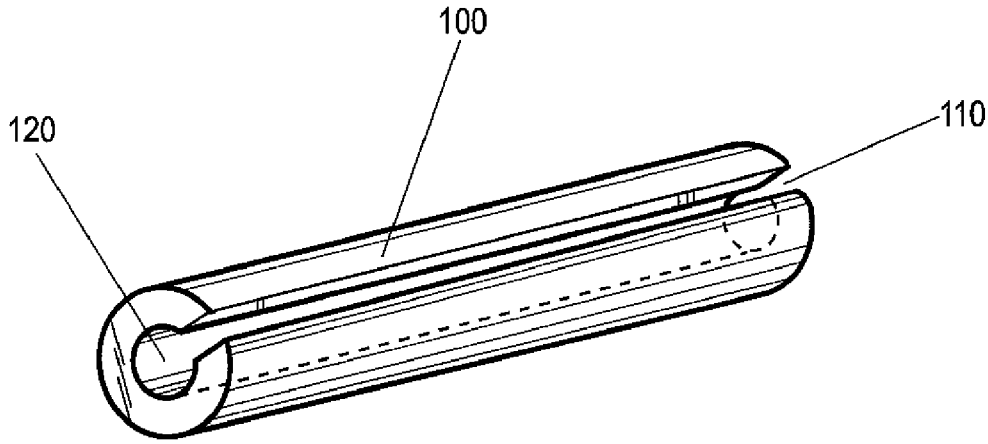
FIG. 8 is a drawing depicting a substantially cylindrically-shaped pad having a longitudinally disposed grove which leads to a hollow passage through which an elastic member can be passed such that the pad is disposed over it.
Figure 9:
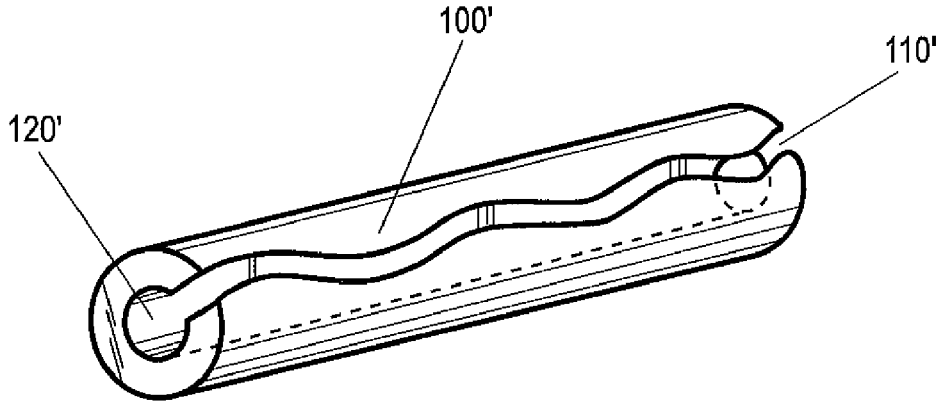
FIG. 9 is a drawing depicting a substantially cylindrically-shaped pad having a curved grove, which leads to a hollow passage, thus allowing the pad to be slipped over an elastic member of the present invention.
Figure 10:
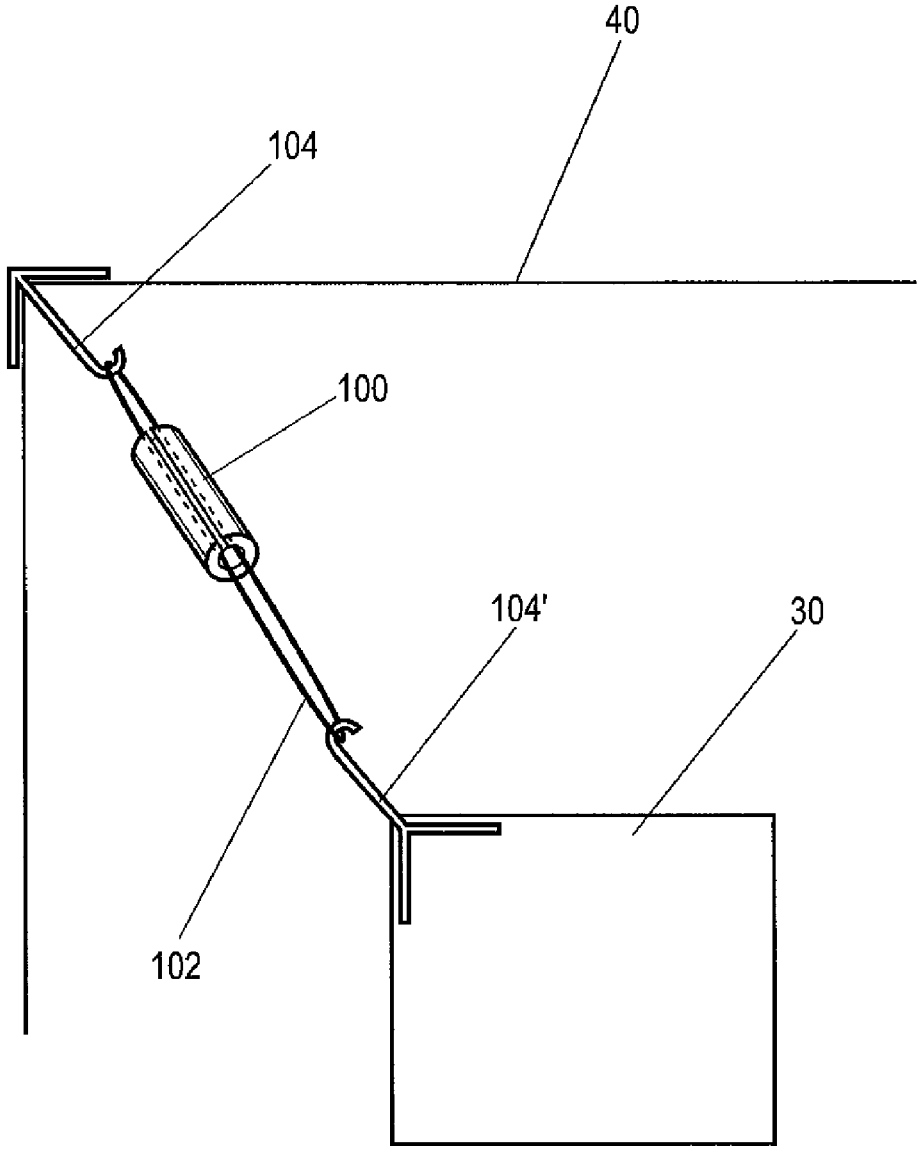
FIG. 10 shows a dampening pad disposed on an elastic member which is stretched between two hooks according to an embodiment of the present invention.

FIGS. 8 and 9 depict substantially cylindrical shaped padded members 100 and 100' having groves 110 and 110' disposed axially therethrough and which groves lead from a surface of pads 100 and 100' to inner openings 120 and 120' respectively, which are axially disposed through pads 100 and 100'. In use, these pads are preferably slipped over an elastic member which is disposed as previously described such that an inner box is suspended within an outer box. The pads disposed on the elastic members act to dampen any reciprocating movement between the inner and outer boxes which would occur if the suspended box is moved with respect to the outer box. The dampening feature of pads 100 and 100' occur not only because of their resistance to being crushed longitudinally when the inner box moves toward the outer box in the area of the pad, but the dampening feature of pads 100 and 100' is further provided by the frictional interference between the elastic member and the inner surfaces of the pad through which the elastic member passes. As such, due to the gripping nature that the pad has on the elastic member, the ability of the elastic member to expand and contract within the pad is suppressed, thus dampening oscillations of the inner box with respect to the outer box. Padded members can be made from a number of materials, particularly materials which provide a cushioning effect. Preferred materials for padded members 100 and 100' include, but are not limited to, open or closed cell foam rubber, or an expanded elastomer. As a visual aid, FIG. 10 shows dampening pad 100 disposed on an elastic member 102 which is stretched between hooks 104 and 104', which themselves are secured to outer box 40 and inner box 30 respectively. Although pad 100 is depicted as having a length of about ½ the length of partially-stretched elastic member 102, pad 100 can be virtually any length which is shorter than the length of partially stretched elastic member 102, optionally, several short pads can be disposed on a single elastic member.

Figure 11:
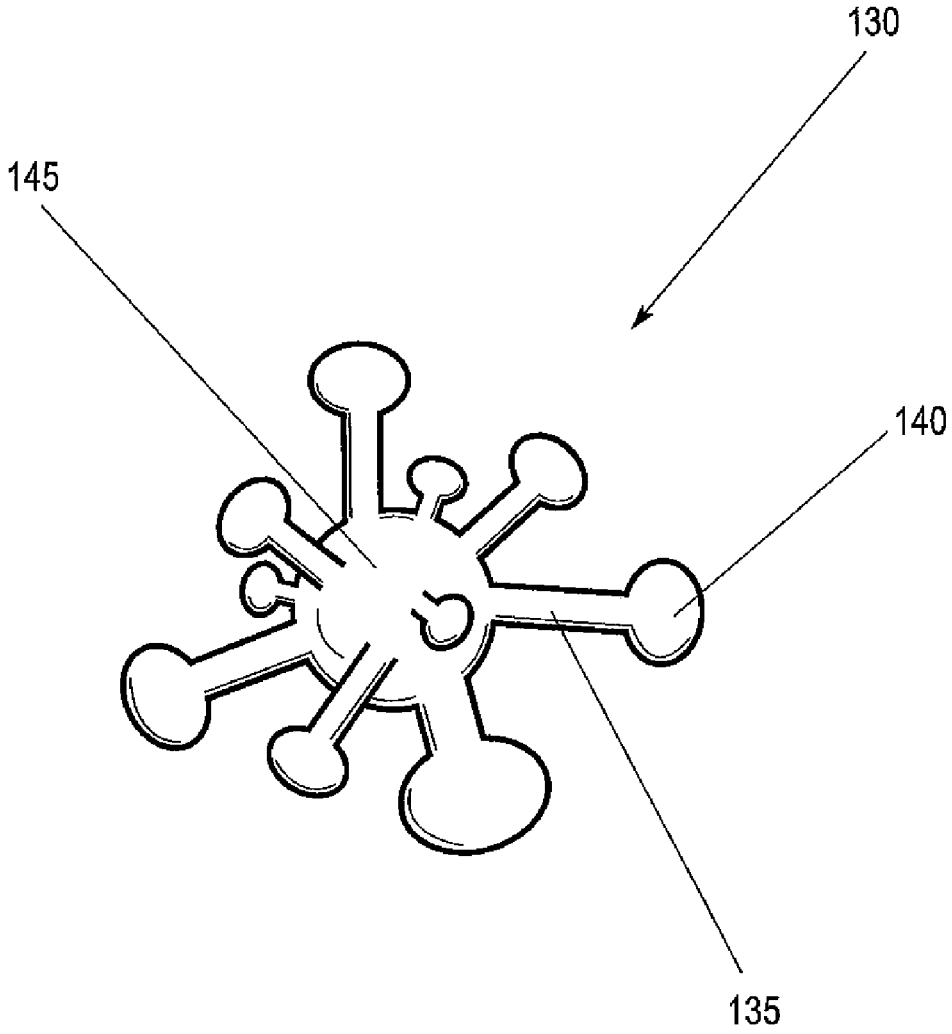
FIG. 11 is a drawing depicting a jack-shaped packing member according to an embodiment of the present invention.

FIG. 11 shows jack-shaped object 130 for absorbing shock in packaging. As depicted therein, shafts 135 with heads 140 protrude in numerous directions from central region 145 of jack 130. While any type of material can be used to make jack-shaped object 130 which has a cushioning effect, it is preferable that jack 130 be made from an elastic material. Jacks 130 are preferably used as packaging material in substantially the same manner in which common packing peanuts are currently used. A primary benefit of using jack-shaped apparatuses 130 over the standard packing peanuts is that when several of the jacks are dumped together, the heads preferably become entangled within the shafts and heads of other jacks, thus causing them to cling together. Jacks 130, so clumped together, however, are easily separated by a user very lightly pulling them apart. Because jacks 130 tend to become entangled, and thus clumped together, items which are packed within the jacks do not experience as much shifting around during shipment as the same items would experience when shipped with standard packing peanuts. Various sizes of jacks 130 can be manufactured and will provide desirable results. However, it is preferred that in use, jack-shaped objects 130 preferably have a substantially uniform size for each instance of use. For example, when used for packing around a box which is one cubic foot in size, numerous jacks that are each about ¾ of an inch in diameter are preferably used. As another example, when used for packing around a box which is about four feet cubed, numerous jacks that are each about two inches in diameter are preferably used.

Figure 12:
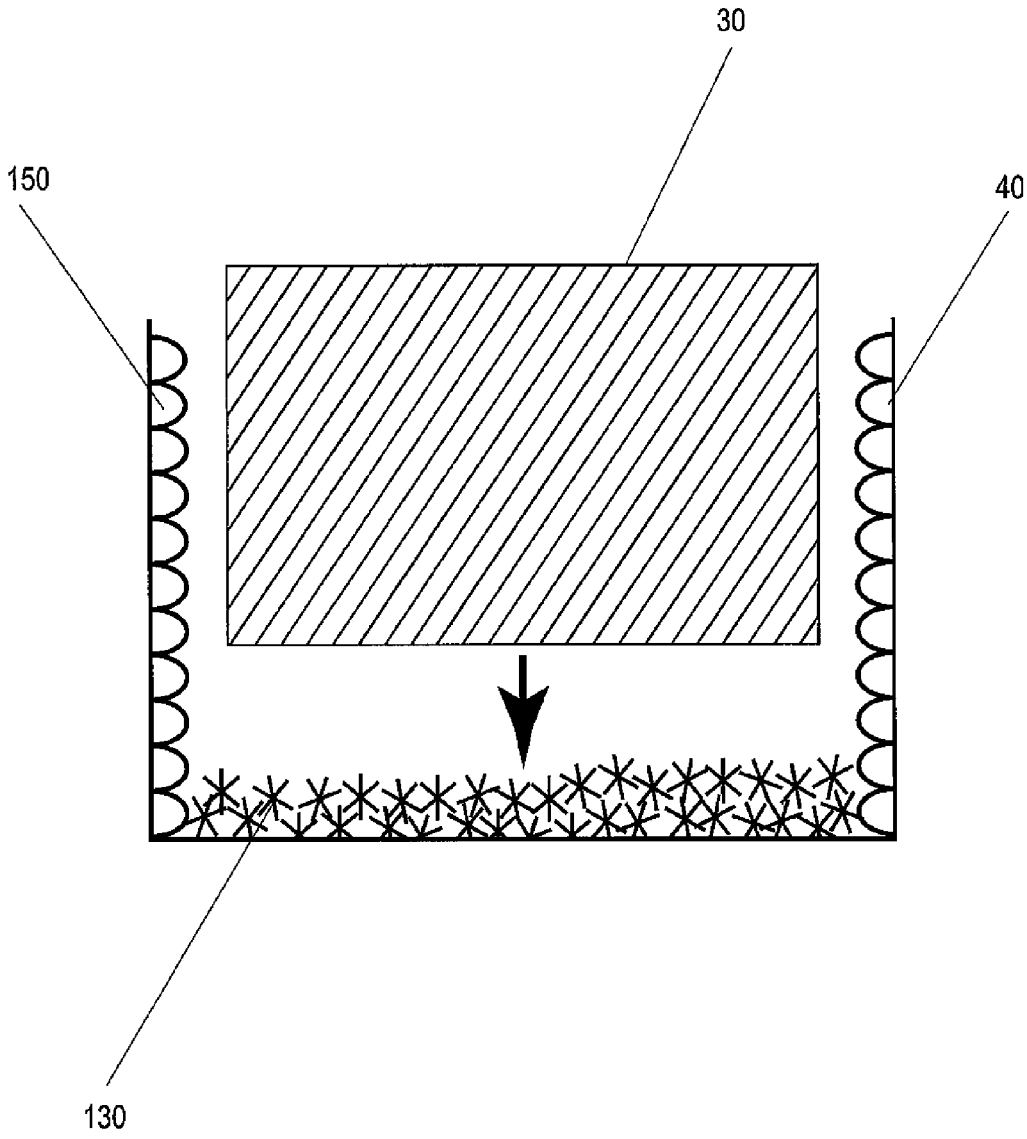
FIG. 12 is a drawing depicting an outer box which contains side-padding as well jack-shaped packing members disposed therein and wherein the side-padding and jack-shaped packing members cushion and contain an inner box.

FIG. 12 depicts an embodiment of the present invention wherein inner box 30 is disposed within outer box 40. Outer box 40 preferably has numerous jack-shaped objects 130 covering its bottom. Padding 150 is preferably disposed on the inside walls of outer box 40. While padding 150 can be made from virtually any padding material, it is preferable that padding 150 be made from an elastic foam. The use of these elements can be used independently, or the elastic member suspension system described above can optionally be incorporated with this packaging system. As such, elastic members can suspend inner box 30 within outer box 40 and jack-shaped objects 130 along with padding 150 can be provided within the outer box such that when inner box 30 does move in a violent manner, padding 150 cushions its impact with outer box 40. Padding 150 also has the additional feature of increasing the structural rigidity of the walls of outer box 40, when padding 150 is fixedly secured thereto. This provides the additional benefit of increasing the crush resistance of outer box 40 when an inward acting force is applied to a side thereof.

Figure 13A:
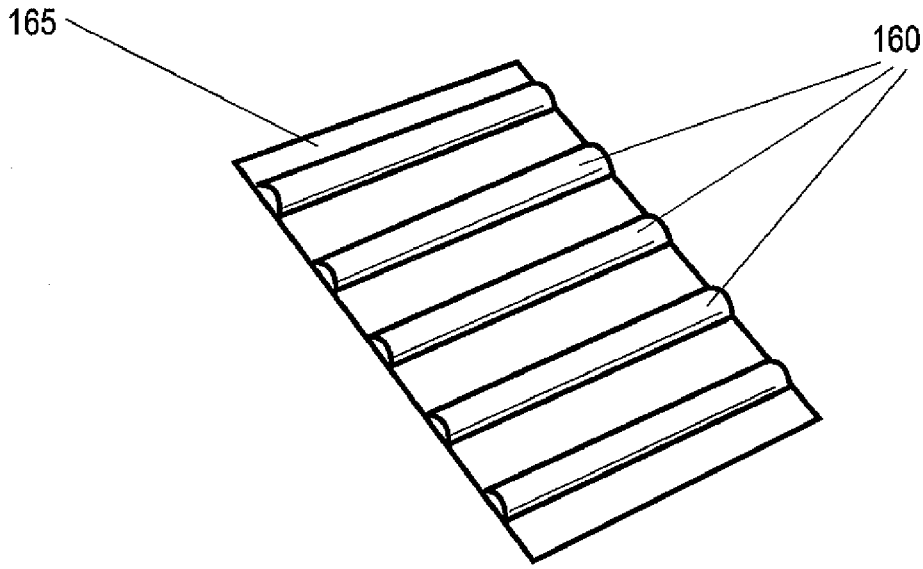
FIGS. 13A and 13B are drawings depicting corrugated foam padding in an unrolled and a rolled state respectively.
Figure 13B:
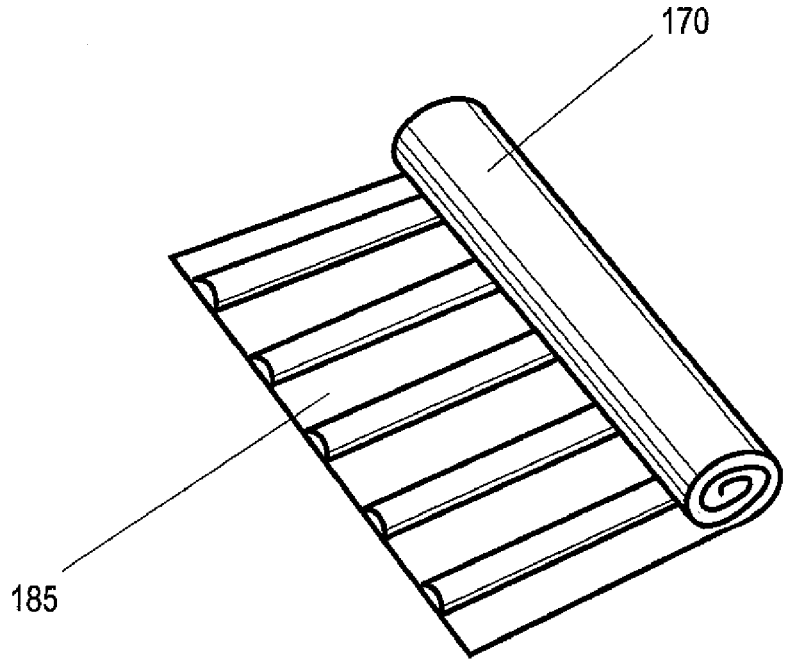

FIGS. 13A and 13B show an embodiment of the present invention wherein a plurality of ribs 160 are preferably fixedly secured to, or otherwise incorporated onto a first side of sheet 165. Sheet 165 is preferably rolled as shown in FIG. 13B, thus forming friction-inducing-cylinder 170 with a plurality of ribbed surfaces 160 disposed circumferentially about an inner surface thereof. After friction-inducing cylinder 170 is formed, it is preferably made to remain in the shape of a cylinder. For example, if a plastic sheeting is used for sheet 165, then after sheet 165 is rolled into cylinder 170, a hot iron can lightly be pressed in one or more spots along cylinder 170, thus causing slight melting of the sheeting into plainer shapes which prevent cylinder 170 from easily unrolling.

Figure 13C:
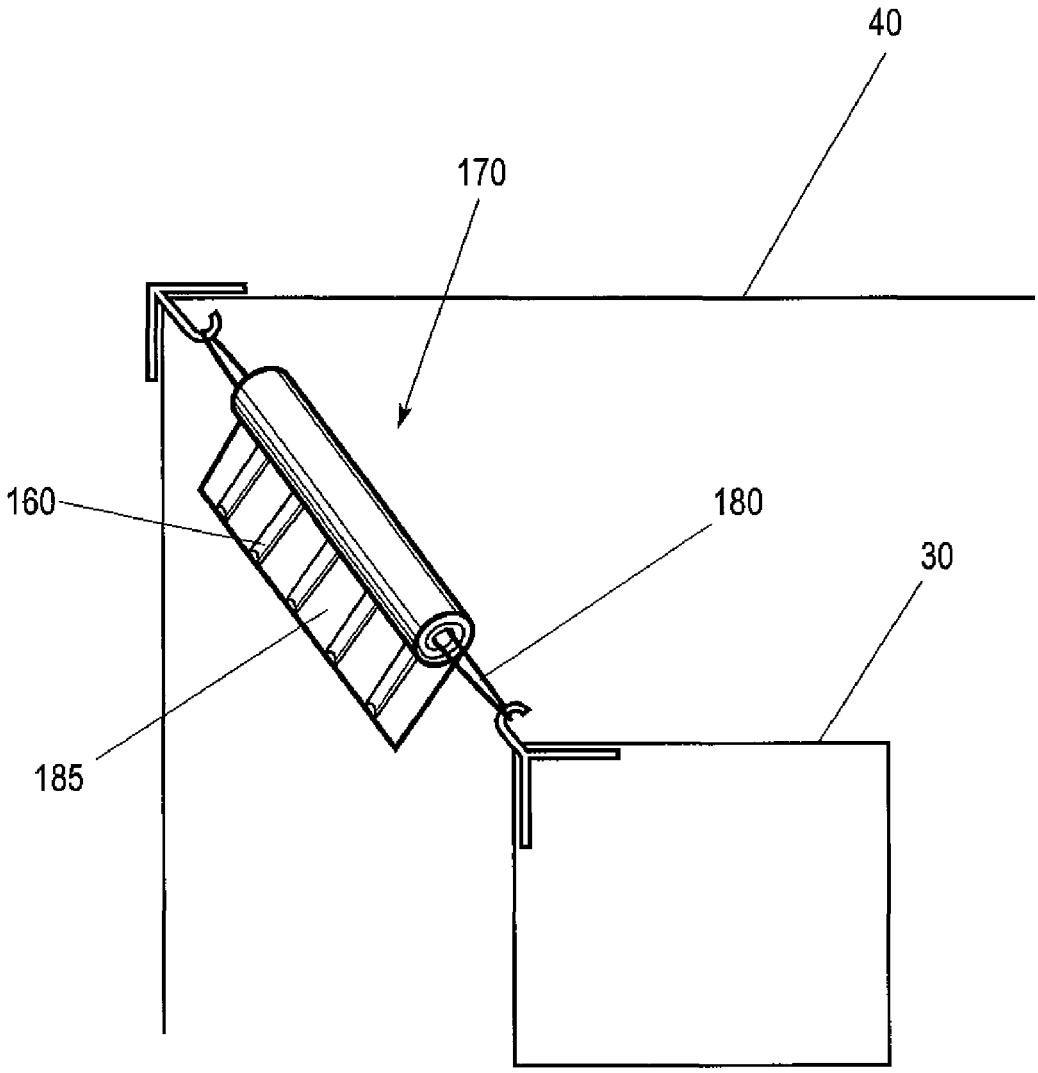
FIG. 13C is a drawing depicting a cylindrical-shaped pad having a plurality of ribs disposed circumferentially throughout an inner diameter thereof, and wherein the pad is disposed over an elastic member stretched between an inner box and an outer box in accordance with embodiments of the present invention.

After cylinder 170 has been caused to remain in a substantially cylindrical shape, cylinder 170 is preferably disposed around an elastic member which is used to suspend an inner box within an outer box as previously described in this application. Referring now to FIG. 13C, while those skilled in the art can generally figure out how to get an elastic member through the inner circumference of cylinder 170, it is preferable that inner box 30 be suspended within outer box 40 with elastic member 180 before cylinder 170 is disposed thereon by lifting end 185 of sheet 165 which resides on an outer diameter of cylinder 170. Elastic member 180 is then disposed within this opening and cylinder 170 is then axially rotated until elastic member 180 is stretched in a co-axial manner with an inner circumference of cylinder 170. Once cylinder 170 is disposed on elastic member 180, cylinder 170 functions in a manner substantially similar to the embodiment of the present invention depicted in FIGS. 8, 9, and 10. As such, ribs 160 are preferably slightly compressed against elastic member 180 and thus cause friction when elastic member 180 attempts to expand or contract through ribs 160. This has a dampening affect on motions of elastic member 180. Cylinder 170 itself resists being crushed in a longitudinal fashion which further acts to resist and thus dampen motion between inner box 30 and outer box 40.

Upon reading this application, those skilled in the art will readily recognize that numerous materials can be used to achieve one or more objectives of this embodiment, and while numerous materials can be used and will produce desirable results, sheet 165 preferably comprises a thin plastic material, such as plastic sheeting. Ribs 160 can be made from numerous materials which provide resistance to an elastic member when used in accordance with this embodiment of the present invention. However, ribs 160 are more preferably made from an expanded foam or a substantially tubular shaped structure made from plastic sheeting which is at least partially filled with a gas. (i.e. ribs 160 can preferably be made in a manner substantially similar to commonly known bubble wrap, except that the bubbles in this embodiment are preferably elongated tubular structures, and that the sheet is rolled and fixed in a substantially cylindrical shape).

Figure 14:
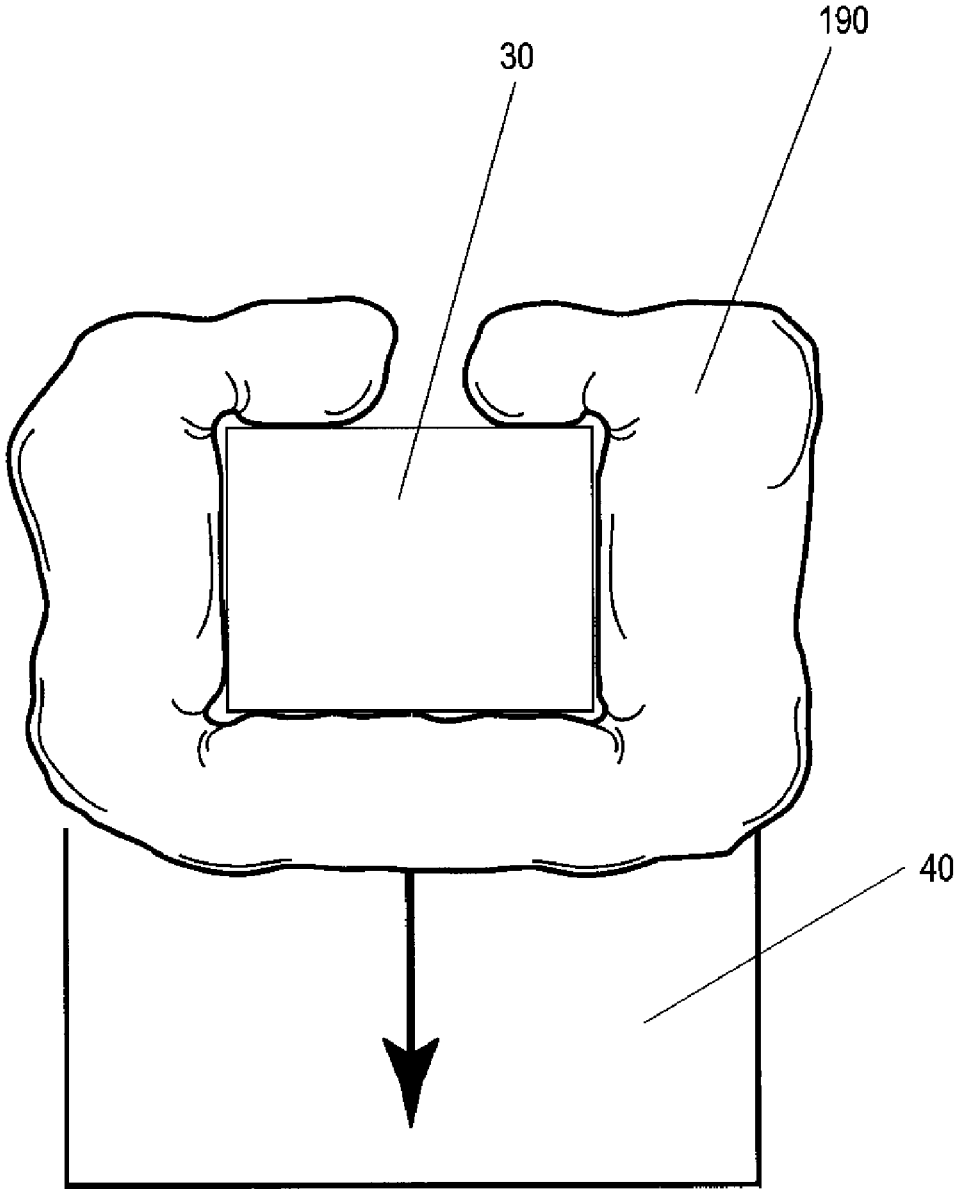
FIG. 14 is a drawing showing a thick expanded elastic foam padding wrapped around an inner box and disposed within an outer box.

FIG. 14 shows an embodiment of the present invention wherein super-expanded foam 190 is at least partially wrapped around inner box 30 before being shoved into outer box 40. Once foam 190 is wrapped around inner box 30, it is preferable that the outside dimensions of foam 190 are preferably slightly greater than the dimensions of outer box 40. As such, upon inserting inner box 30 into outer box 40, super-expanded foam 190 is preferably compressed. Compression of super-expanded foam 190, upon insertion into outer box 40, is preferably between about 20% to about 80% of its total thickness, and more preferably between about 40% to about 60%, and still further preferably about 50% compressed. While foam 190 can be made from numerous materials capable of providing padding and capable of being expanded in such a way as to create a compressive and resilient foam, it is preferable that foam 190 be made from a super-expanded elastic foam. Foam 190 is preferably compressible to just 20% of its expanded thickness, and more preferably is compressible to just 10% of its expanded thickness, and most preferably is compressible to less than 10% of its expanded thickness. With foam 190 compressed on both sides of inner box 30, when box 30 shifts toward one side of outer box 40 during shipping, the foam can preferably compress further on the forward side of box 30 and expand to fill any void created on the aft side of box 30. While various thicknesses of super-expanded foam 190 can be used and will produce desirable results, it is preferable that foam 190 have an expanded thickness of about 2 to about 8 inches, and more preferably from about 3 to about 6 inches, and most preferably about 4 inches in thickness.

Figure 15A:
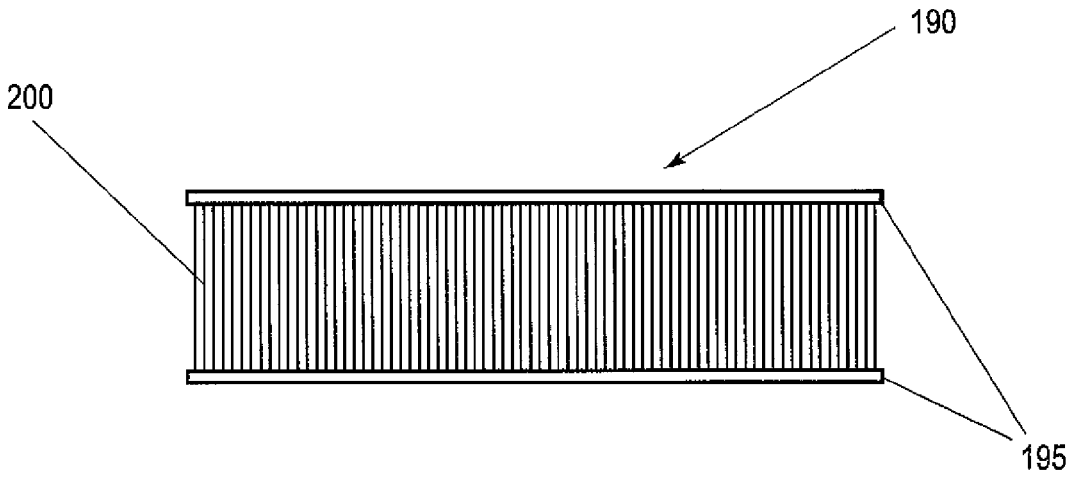
FIGS. 15A and 15B are close-up drawings showing alternative embodiments for preferred construction of the super expanded foam padding according to the present invention.
Figure 15B:
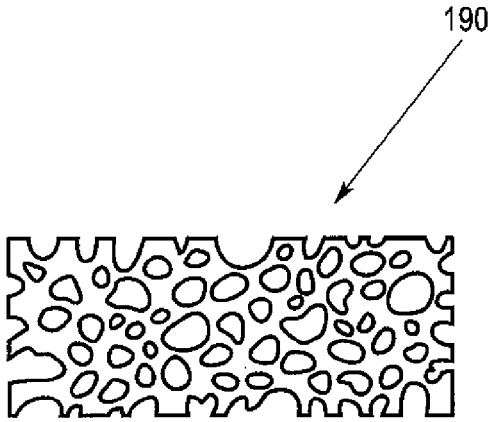

Although other embodiments can produce desirable results, FIGS. 15A and 15B depict alternative preferred embodiments for the construction of super-expanded foam 190. In FIG. 15A, foam 190 preferably comprises a sandwiched structure wherein a plurality of thin elastic sheets 195 are separated by elastic strands or posts 200. In the alternative embodiment of FIG. 15B, foam 190 is preferably a single structure which comprises a sponge shape and is preferably created by injecting a gas into a liquid elastic material under high pressure and which gas expands to create voids in the elastic material when the surrounding pressure is reduced, and which liquid elastic material then solidifies into an expanded sponge-like structure.

Figure 16A:
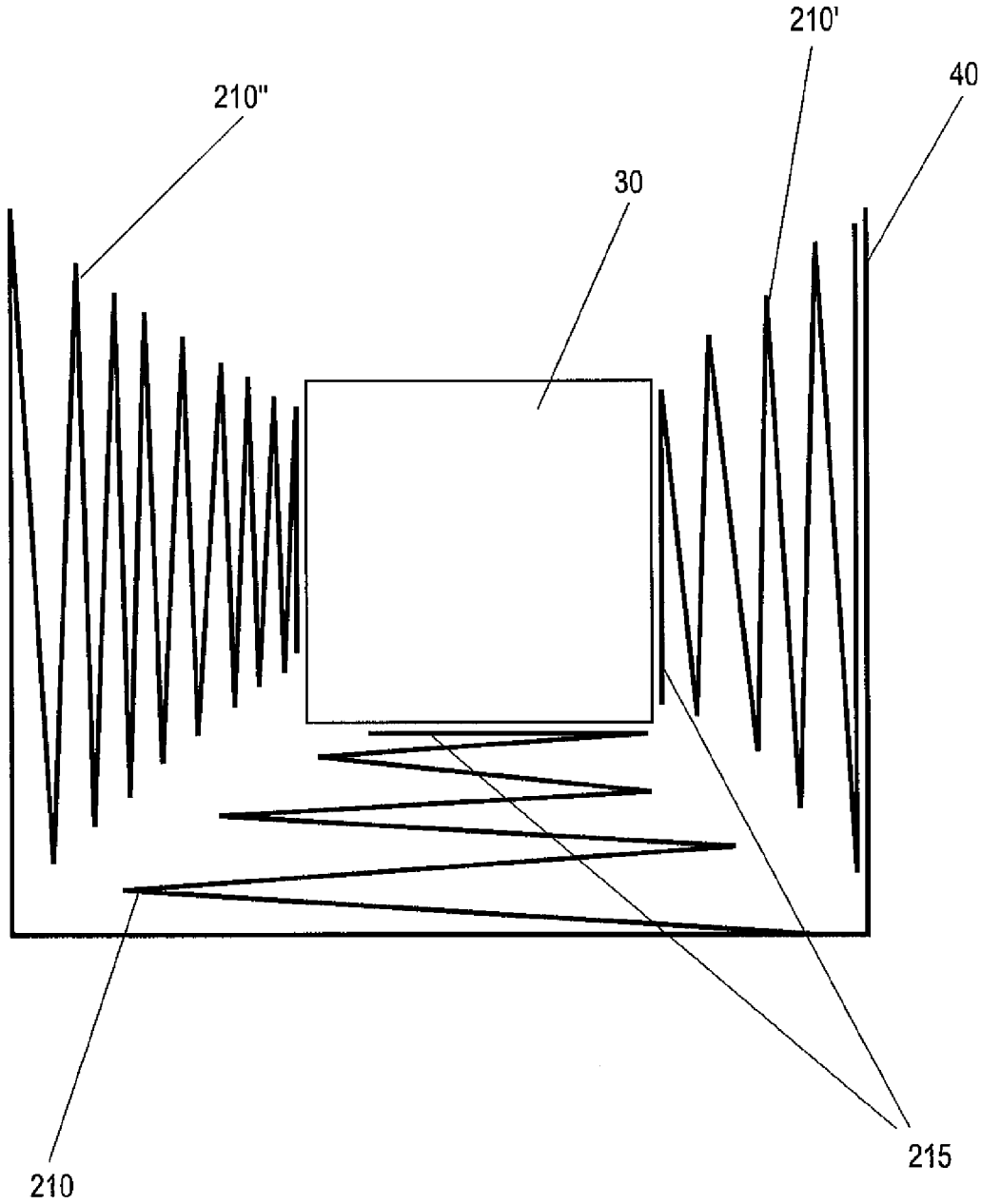
FIG. 16A is a drawing depicting a plurality of springs disposed within an outer box which are supporting and cushioning an inner box.
Figure 16B:
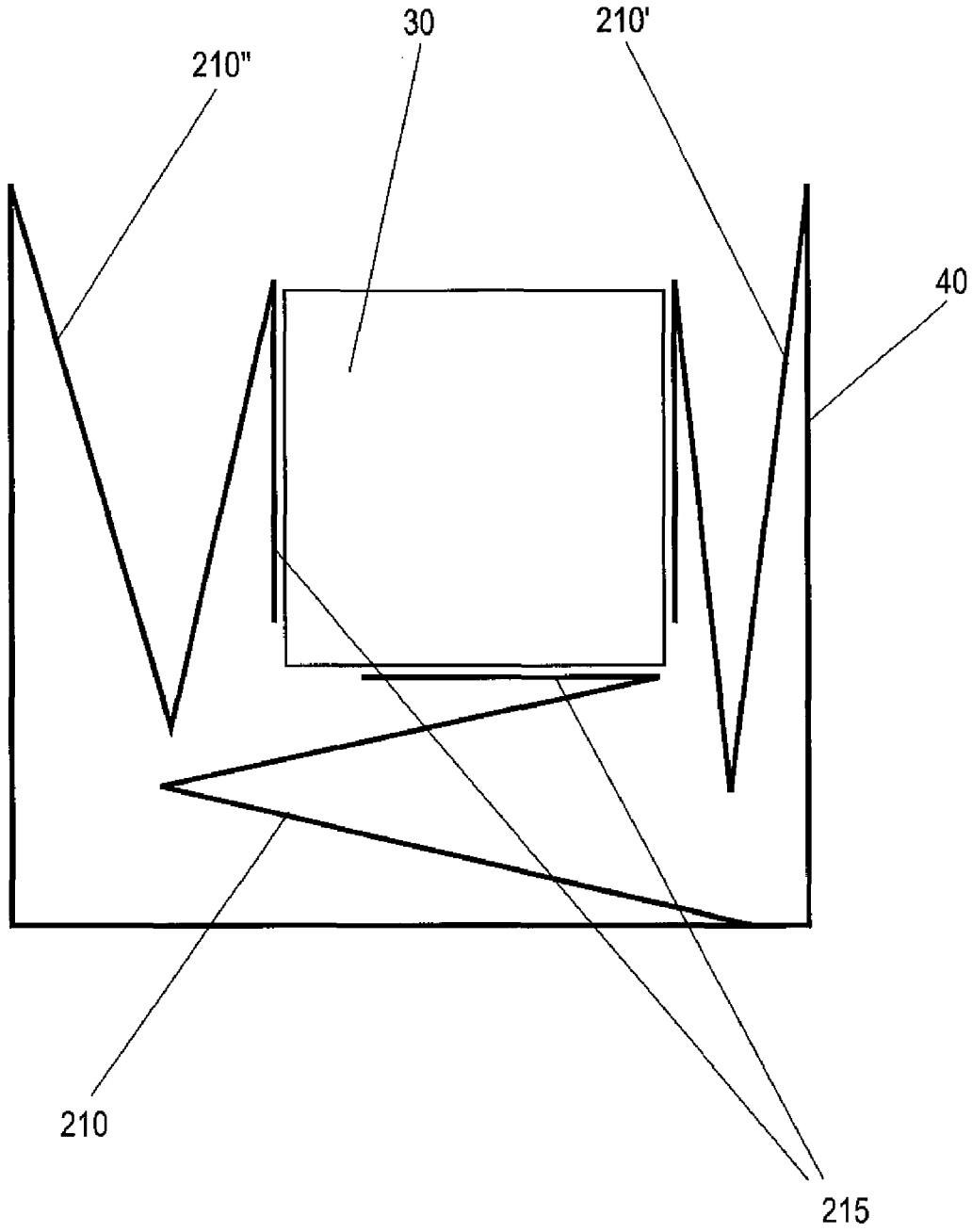
FIG. 16B is a drawing depicting a plurality of springs disposed within an outer box which are supporting and cushioning an inner box which has shifted toward a side of the outer box.

FIGS. 16A and 16B are drawings depicting an embodiment of the present invention wherein a plurality of springs 210, 210' and 210" are used to support inner box 30 within the confines of outer box 40. As such, in this embodiment spring 210 is preferably first disposed in a bottom of outer box 40. Inner box 30 can then be disposed thereon. Springs 210' and 210" can then be partially compressed by hand and inserted in such a manner that they exert force between the sides of inner box 30 and the sides of outer box 40. An additional top spring (not shown) can optionally be used to exert a force between a top of inner box 30 and outer box 40. It is preferable that when all springs have been installed, each spring is partially compressed so that when inner box 30 moves relative to outer box 40, the spring on the leading side of inner box 30 is compressed even more while the spring on the aft side of inner box 30 extends to follow inner box 30 (see FIG. 16B). Upon reading this application, those skilled in the art will recognize that an almost infinite number of spring apparatuses, mechanisms, and/or devices of various shapes, sizes, coil counts, and designs can be used and will produce desirable results, particularly depending on the cargo to be shipped. For example, the springs used to ship a lightweight and very delicate vase will preferably exert much less force than the springs which would be used to ship a very heavy jet turbine. Further, although only 3 springs are depicted in the drawings, any number of springs can be provided. For example, springs can be disposed on all 4 sides of outer box 30, and on a top and bottom of inner box 30, or optionally a spring can be disposed only above and below inner box 30.

Inner surfaces 215 of springs 210, 210' and 210", as well as any additional springs used, are preferably interfacing surface 215 which preferably have a relatively low frictional coefficient. This permits inner box 30 to slide around on the springs. For example, if inner box 30, as depicted in FIGS. 16A and 16B, experiences an up or down motion with respect to outer box 40, inner box 30 can preferably easily slide up and down with respect to side springs 210' and 210" due to the low frictional coefficient of surface 215. By increasing the frictional coefficient of surfaces 215, a dampening effect is created by the introduction of some resistance to the ability of inner box 30 to slide around with respect to the springs. Inner surface 215 can comprise any surface, structure, apparatus, or mechanism which has a lower frictional coefficient than the springs themselves. For example, surfaces 215 can include a Teflon coating, a Teflon sheet disposed between the springs and the outer surfaces of inner box 30, and/or rollers or ball bearing type structures. If rollers or ball bearing type structures and/or devices are used for inner surface 215, such structures and/or devices can be as friction free as possible, or optionally can provide some resistance to movement thereof and thus provide the dampening function previously discussed.

Upon studying this application, other embodiments of the present invention will become readily recognized by those skilled in the art, particularly as to the manner of attachment between the elastic members and the box surfaces. For example, a user could easily tie a knot at each end of a length of an elastic member, the knot could then be slid into a slot provided in the fastening members or the boxes themselves. Another example is that multiple embodiments of the present invention can be used in conjunction with one another and desirable results will be produced.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above and/or in the attachments, and of the corresponding application(s), are hereby incorporated by reference.

What is claimed is:

1. A method for shipping an item comprising:

disposing the item in an inner box;

connecting three or more hooks to two or more corners of the inner box, wherein at least one of the hooks is attached to a sheet and wherein at least one of the three or more hooks is passed through at least one corner of a corner of the inner box, such that the hook is on an outside of the inner box and the sheet is on an inside of the inner box;

disposing the inner box at least partially within an outer box; and separating the inner box from the outer box at three or more points by attaching at least one elastic member between the three or more hooks and the outer box.

2. The method of claim 1 further comprising attaching a hook to the outer box.

3. The method of claim 1 wherein separating comprises separating the inner box from the outer box at three or more points by disposing at least one elastic member between each of the three or more points.

4. The method of claim 1 further comprising disposing a dampening pad on at least one of the elastic members.

5. The method of claim 1 wherein at least one hook comprises a point.

6. A method for shipping an item comprising:

disposing the item in an inner box;

connecting three or more hooks to two or more corners of the outer box, wherein at least one of the hooks is attached to a sheet and wherein the hook is passed through at least one corner of a corner of the outer box, such that the hook is on an inside of the outer box and the sheet is on an outside of the outer box;

disposing the inner box at least partially within an outer box; and separating the inner box from the outer box at three or more points by connecting the inner box to the three or more hooks with at least one elastic member.

7. The method of claim 6 further comprising attaching a hook to the inner box.

8. The method of claim 6 wherein separating comprises separating the inner box from the outer box at three or more points by disposing at least one elastic member on each hook.

9. The method of claim 6 further comprising disposing a dampening pad on at least one of the elastic members.

10. A method for packaging an item for shipping, the method comprising:

disposing the item within an inner box;

disposing the inner box at least partially within an outer box; and connecting the inner box with the outer box at three or more points with at least one elastic member, wherein connecting comprises providing three or more hooks, wherein at least one of the hooks is fixedly secured to at least one sheet, and wherein connecting comprises passing the at least one hook through a corner of a corner of the inner box such that the sheet is disposed on an inside of the inner box and the at least one hook extends through the inner box such that the at least one hook resides on an outside of the inner box.

11. The method of claim 10 wherein the sheet comprises an angled sheet.

12. The method of claim 10 further comprising disposing a dampening pad on the elastic member.

13. The method of claim 12 wherein the sheet is disposed at a corner of the inner box.

14. The method of claim 10 wherein providing three or more hooks comprises providing one or more hooks comprising a point.

15. A method for packaging an item for shipping, the method comprising:

disposing the item within an inner box;

disposing the inner box at least partially within an outer box; and connecting the inner box with the outer box at three or more points with at least one elastic member, wherein connecting comprises providing three or more hooks, wherein at least one of the hooks is fixedly secured to at least one sheet, and wherein connecting comprises passing the at least one hook through a corner of a corner of the outer box such that the sheet is disposed on an outside of the outer box and the at least one hook extends through the outer box such that the at least one hook resides on an inside of the outer box.

16. The method of claim 14 wherein the sheet comprises an angled sheet.

17. The method of claim 14 wherein a second sheet is disposed at a corner of the outer box.

18. The method of claim 15 wherein the sheet is disposed at a corner of a corner of the outer box.

* * * * *